US007231981B2

(12) United States Patent
Moe et al.

(10) Patent No.: US 7,231,981 B2
(45) Date of Patent: Jun. 19, 2007

(54) INLINE COMPENSATOR FOR A FLOATING DRILL RIG

(75) Inventors: Magne Mathias Moe, Harstad (NO); Åge Kyllingstad, Ålgård (NO)

(73) Assignee: National Oilwell, L.P., Houston, TX (US)

( * ) Notice: Subject to any disclaimer, the term of this patent is extended or adjusted under 35 U.S.C. 154(b) by 243 days.

(21) Appl. No.: 10/957,479

(22) Filed: Oct. 1, 2004

(65) Prior Publication Data

US 2005/0077049 A1 Apr. 14, 2005

Related U.S. Application Data

(60) Provisional application No. 60/509,623, filed on Oct. 8, 2003.

(51) Int. Cl.
*E21B 29/12* (2006.01)

(52) U.S. Cl. ..... 166/355; 166/352; 405/224.4; 175/7

(58) Field of Classification Search ..... 166/355, 166/354, 352, 350; 405/168.4, 223.1–224.4; 175/5, 7, 8
See application file for complete search history.

(56) References Cited

U.S. PATENT DOCUMENTS 3,280,908 A * 10/1966 Todd ..... 166/340
3,313,345 A * 4/1967 Fischer ..... 166/355
3,643,751 A * 2/1972 Crickmer ..... 175/7
3,785,445 A 1/1974 Scozzafava ..... 175/5
3,793,835 A * 2/1974 Larralde ..... 60/413
3,841,607 A * 10/1974 Larralde et al. ..... 254/392
3,897,045 A * 7/1975 Butler ..... 254/392
3,917,006 A * 11/1975 Kellner ..... 175/5
4,215,950 A * 8/1980 Stevenson ..... 405/168.4
4,222,341 A 9/1980 Larsen et al. ..... 114/264

(Continued)

FOREIGN PATENT DOCUMENTS

EP 1 103 459 A1 11/1999

(Continued)

OTHER PUBLICATIONS

*Active Heave Drilling® (AHD) Drawworks*, National Oilwell 2004.

*Primary Examiner*—Thomas A Beach
(74) *Attorney, Agent, or Firm*—Howrey LLP

(57) ABSTRACT

An apparatus and method for protecting against the problems associated with heave of a floating drilling rig are disclosed. The disclosed invention is a unique inline compensator in which a plurality of cylinders housed within a tubular housing and a plurality of low pressure and high pressure accumulators function together to provide a system for compensating for heave in the event a primary heave compensation system fails or becomes inoperative. The typical inline compensator of the present invention utilizes a plurality of hydraulic cylinders that act in opposite directions and that have different piston areas such that the piston rods of the cylinders are extended or retracted at different pressure levels to account for heave. The typical inline compensator of the present invention is self-contained and compact enough to fit in the limited space available on a floating drilling structure. Further, a pair of inline compensators of the present invention can be utilized with coiled tubing operations. In such a case, the inline compensators will not interfere with the tooling necessary to conduct the coiled tubing operations.

72 Claims, 10 Drawing Sheets

U.S. PATENT DOCUMENTS

| | | | | | |
|---|---|---|---|---|---|
| 4,400,109 | A | | 8/1983 | Gentry et al. | 405/195 |
| 4,432,420 | A | | 2/1984 | Gregory et al. | 166/355 |
| 4,487,150 | A | | 12/1984 | Shanks | 114/264 |
| 4,501,219 | A | | 2/1985 | Bates, Jr. | 114/264 |
| 4,615,542 | A | * | 10/1986 | Ideno et al. | 285/11 |
| 4,712,620 | A | | 12/1987 | Lim et al. | 166/355 |
| 4,799,827 | A | | 1/1989 | Jaqua | 405/195 |
| 5,069,488 | A | * | 12/1991 | Freyer et al. | 285/302 |
| 5,088,859 | A | | 2/1992 | Devlin | 405/211 |
| 5,520,369 | A | | 5/1996 | Chatard | 254/277 |
| 5,641,248 | A | | 6/1997 | Arit, III | 405/195.1 |
| 5,846,028 | A | | 12/1998 | Thory | 405/195.1 |
| 5,881,815 | A | * | 3/1999 | Horton, III | 166/350 |
| 6,000,480 | A | | 12/1999 | Eik | 175/8 |
| 6,148,922 | A | | 11/2000 | Vatne | 166/367 |
| 6,530,430 | B2 | | 3/2003 | Reynolds | 166/346 |
| 6,554,072 | B1 | | 4/2003 | Mournian et al. | 166/355 |
| 6,739,395 | B2 | | 5/2004 | Reynolds | 166/346 |
| 6,968,900 | B2 | * | 11/2005 | Williams et al. | 166/355 |
| 7,008,340 | B2 | * | 3/2006 | Williams et al. | 474/101 |

FOREIGN PATENT DOCUMENTS

| | | | |
|---|---|---|---|
| GB | 2 358 032 | A | 1/2000 |
| WO | WO 2004/044374 | A1 | 5/2004 |

* cited by examiner

B-B

A-A

C-C

INLINE COMPENSATOR FOR A FLOATING DRILL RIG

This application claims the benefit of U.S. Provisional Application No. 60/509,623, filed Oct. 8, 2003.

FIELD OF THE INVENTION

The present invention relates to an inline compensator apparatus and method for use on floating drilling rigs and workover or production vessels. In particular, the invention relates to an inline compensator apparatus that functions as a back-up system for the primary or main heave compensation system of a floating drilling rig or vessel in the event the primary heave compensation system becomes disabled or inoperative.

BACKGROUND OF THE INVENTION

Drilling for oil and gas off-shore is completed from one of two types of drilling rigs: rigs that are supported by the sea floor (such as fixed drilling rigs or jack-up drilling rigs) or rigs that float on the surface of the water (such as drill ships or semi-submersible drilling rigs). Although drilling operations conducted from these two types of drilling rigs are similar, at least one major difference exists: drill ships or semi-submersible drilling rigs move with the waves of the sea, while fixed or jack-up drilling rigs remain fixed to the sea floor.

The movement of drill ships or semi-submersible drilling rigs with the waves of the sea presents a unique problem in drilling with these types of rigs. First, in any drilling operation conducted from floating rigs, compensation for the rig's tendency to heave—that is move up and down with the waves—must be accounted for. In particular, as the floating rig moves up and down, the drill string and drill bit extending below the rig will also move up and down. For a drill bit to perform as efficiently as possible, the desired or optimum weight on the drill bit—i.e., the downward force applied to the bit—must be kept as constant as possible. Heave, however, removes weight from the drill bit as the ship or rig rides to the crest of a wave, and puts weight back on the drill bit as the ship or rig rides down into the trough between waves. This fluctuation in the force applied on the drill bit severely hinders an operator's ability to drill the well bore. See Ron Baker, *A Primer of Offshore Operations*, pgs. 55–63 (Univ. of Texas Petroleum Extension Servs., 2$^{nd}$ Ed., 1985).

Perhaps more importantly, heave creates the potential for blowouts due to a potential fracturing or breaking of the production tubing during testing, workover, or completion operations. Specifically, once the well bore has been drilled, the oil and gas reserves are brought up to the floating rig through production tubing that runs from the rig to the producing zones of the well bore—typically thousands of feet below the sea floor. The string of production tubing consists of dozens, if not hundreds, of joints of tubing—typically approximately 30 feet in length each—connected together. The production tubing is supported by and is kept in tension by the drill hook and drawworks on the drilling rig to keep the string from buckling.

The production tubing is typically held in place within the well bore by one or more production packers. Because the production tubing is held in place within the well bore, any rise of the floating drilling rig due to heave will increase the tension on the production tubing string and could cause the string to fracture or break. A fracturing or breaking of the production tubing string would allow the oil or gas within the tubing to leak, creating the potential for a blowout.

To account for the problems associated with heave, floating drilling rigs are equipped with a heave compensation system. The heave compensation system is typically in the form of an active heave drawworks system or a system that is an integral part of the drilling derrick or mounted directly on an extension of the traveling block. When functioning properly, these primary heave compensation systems are capable of protecting against the effects of heave. However, prior art floating drilling rigs are generally not equipped with a back-up, or secondary, heave compensation system that operates in the event the primary heave compensation system is not functioning properly or becomes inoperative. In such a situation, the floating drilling rig will have no way to compensate for heave.

One possible reason why back-up heave compensation systems have not previously been utilized on drill ships or semi-submersible drilling rigs is the limited space available on the derrick of such floating rigs. Further, the possible locations on the drilling derrick or drill floor that a back-up heave compensation system can be placed is limited by the necessity to allow access to the production tree on the drilling rig. Such access is necessary to conduct numerous drilling operations, including the potential for conducting coiled-tubing operations. These space and placement limitations are likely a significant part of the reason why prior art floating drilling rigs have heretofore not been equipped with a back-up heave compensation system.

Accordingly, what is needed is a heave compensation system that acts as a back-up system to the primary heave compensation system and that is compact enough to fit in the limited space available on a floating drilling rig. It is, therefore, an object of the present invention to provide a heave compensation apparatus that is normally static when the primary heave compensation system is operative, but becomes operative if the primary heave compensation system malfunctions or becomes inoperative. It is a further object of the present invention to provide a back-up heave compensation system that is compact and self-contained such that it can be installed in the limited space available on a floating drilling rig. Those and other objectives will become apparent to those of skill in the art from a review of the specification below.

SUMMARY OF THE INVENTION

An apparatus for providing a back-up heave compensation system is disclosed. The disclosed invention is a unique inline compensator in which a plurality of cylinders housed within a tubular housing and one or more low pressure and high pressure accumulators function together to provide a system for compensating for heave in the event a primary heave compensation system fails or becomes inoperative. The inline compensator of the present invention utilizes a plurality of hydraulic cylinders that act in opposite directions and that have different piston areas such that the piston rods of the cylinders are extended or retracted at different levels of pulling (i.e., tensile) force to account for heave. The inline compensator of the present invention is self-contained and compact enough to fit in the limited space available on a floating drilling structure.

In one aspect, the present invention relates to an inline compensator apparatus for a floating vessel comprising an outer housing sealed on both ends by end caps; a first inner cylinder housed at least partially within the outer housing, the first inner cylinder having a first diameter and having a piston head and a piston rod therein; a second inner cylinder housed at least partially within the outer housing, the second inner cylinder having a second diameter and having a piston head and a piston rod therein, wherein the cross-sectional area of the piston head of the first inner cylinder is greater than the cross-sectional area of the piston head of the second inner cylinder, the piston rod of the first inner cylinder extends through an end cap of the outer housing and has a connecting lug on the end of the piston rod outside the outer housing, and the piston rod of the second inner cylinder extends through the other end cap of the outer housing and has a connecting lug on the end of the piston rod outside the outer housing such that the piston rods can be extended and retracted to account for heave of the floating vessel; one or more low pressure accumulators in communication with the low pressure side of the piston heads of both the first and second inner cylinders; and a high pressure accumulator in communication with the high pressure side of the piston heads of both the first and second inner cylinders, the high pressure accumulator comprising the open volume surrounding the inner cylinders within the outer housing.

In another aspect, the present invention relates to an inline compensator apparatus for a floating vessel comprising an outer housing sealed on both ends by end caps; an inner cylinder of a first diameter housed at least partially within the outer housing, the inner cylinder having a piston head and a piston rod therein; a plurality of inner cylinders of a second diameter housed at least partially within the outer housing, the plurality of inner cylinders each having a piston head and a piston rod therein, wherein the plurality of inner cylinders are spaced about the circumference of the inner cylinder of a first diameter, the total cross-sectional area of the piston heads of the plurality of inner cylinders is greater than the cross-sectional area of the piston head of the inner cylinder of a first diameter, the piston rod of the inner cylinder of a first diameter extends through an end cap of the outer housing and has a connecting lug on the end of the piston rod outside the outer housing, and the piston rods of the plurality of inner cylinders extend through the other end cap of the outer housing and each have a connecting lug on the end of the piston rod outside the outer housing such that the piston rods can be extended and retracted to account for heave of the floating vessel; one or more low pressure accumulators in communication with the low pressure side of the piston heads of both the inner cylinder of a first diameter and the plurality of inner cylinders; and a high pressure accumulator in communication with the high pressure side of the piston heads of both the inner cylinder of a first diameter and the plurality of inner cylinders, the high pressure accumulator comprising the open volume surrounding the inner cylinders within the outer housing.

In another aspect of the present invention, the inline compensator apparatus comprises a means for connecting the inline compensator to the floating vessel's hoisting system and to sea bottom connected systems, such systems including, but not limited to, a production head on the floating vessel, a drill string of a floating drilling rig, production tubing, and/or other well bore tubulars that extend from a floating vessel to the sea bottom.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 12 shows the inline compensators in the normal operating position when the primary heave compensation system is functioning properly.

DESCRIPTION OF ILLUSTRATIVE EMBODIMENTS

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Figure 1:
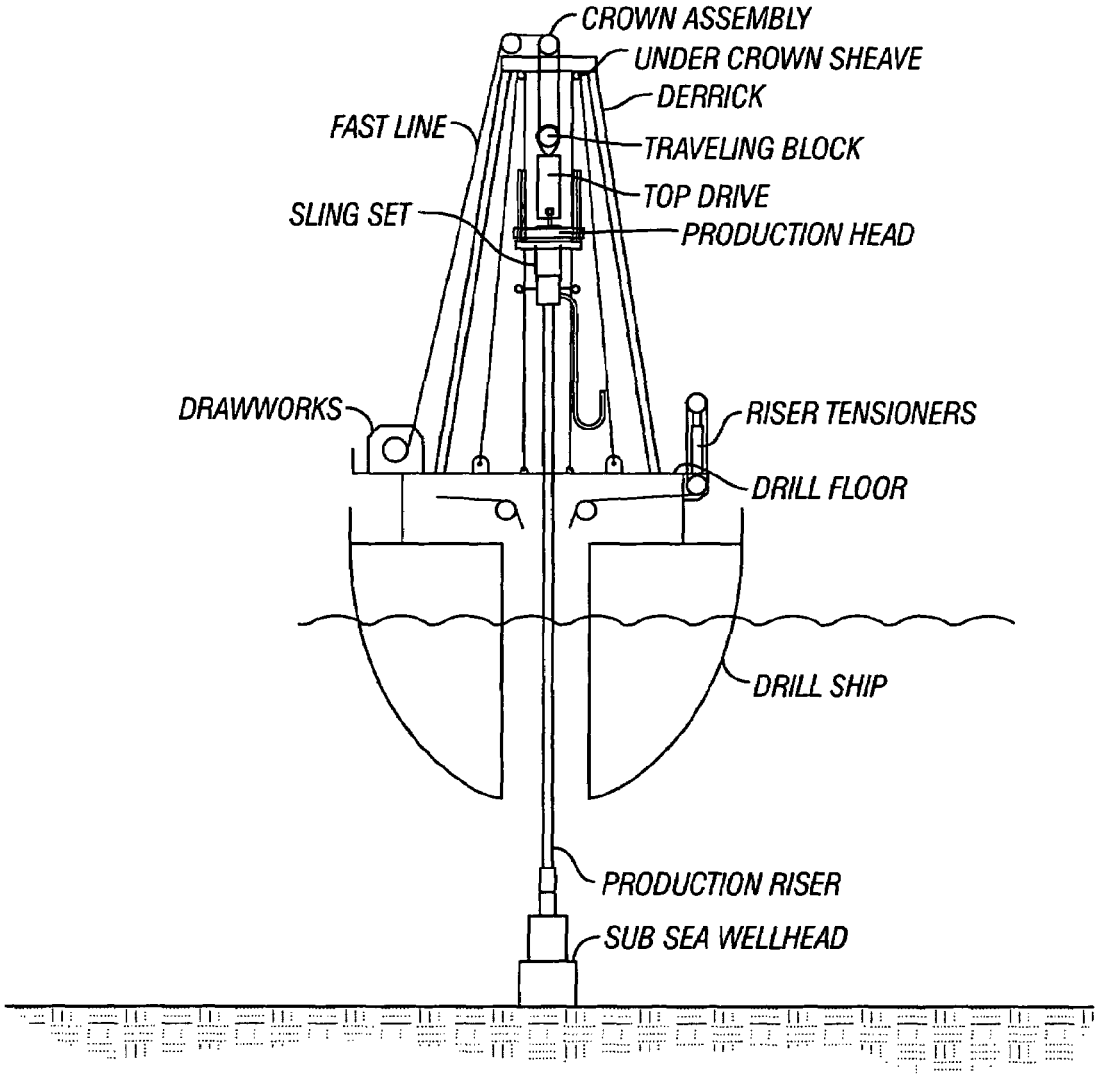
FIG. 1 (Prior Art)
FIG. 1 is a cross-sectional view of a typical drill ship (looking from the stern of the drill ship) showing various components of the drill ship used in drilling for oil and gas reserves offshore.

Referring to FIG. 1, various components of a typical drill ship are shown. As shown in FIG. 1, the drill ship has a drill floor that supports a riser tensioning system that maintains the production riser (the conduit that extends from the drill ship to the subsea Christmas tree or wellhead) in tension. The drawworks for the rig is also mounted on the drill floor. In some floating drilling rigs, the drawworks will have an active heave drawworks system as the primary heave compensation system.

A drilling derrick extends upwardly above the drill floor. The drilling derrick contains the main hoisting and tubular components used in drilling operations. Specifically, as shown in FIG. 1, the drill line, or fast line, runs from the drawworks to the top of the drilling derrick where it is integrated into the crown block assembly. From the crown block, the drill line is run down and spooled around the traveling block. By extending or retracting the amount of drill line that is spooled on the drawworks, the traveling block can be raised or lowered during drilling operations. The top drive, which is installed just below the traveling block as shown in FIG. 1, is used to rotate the drillstring during drilling operations.

The primary heave compensation system for the drill ship depicted in FIG. 1 is either an active heave drawworks system or a top compensation system mounted on the top of the derrick. As discussed above, if this primary heave compensation system becomes disabled or inoperative for some reason, the drill ship has no way to account for the vessel's heave without a back-up or secondary heave compensation system such as the one disclosed herein.

Figure 2:
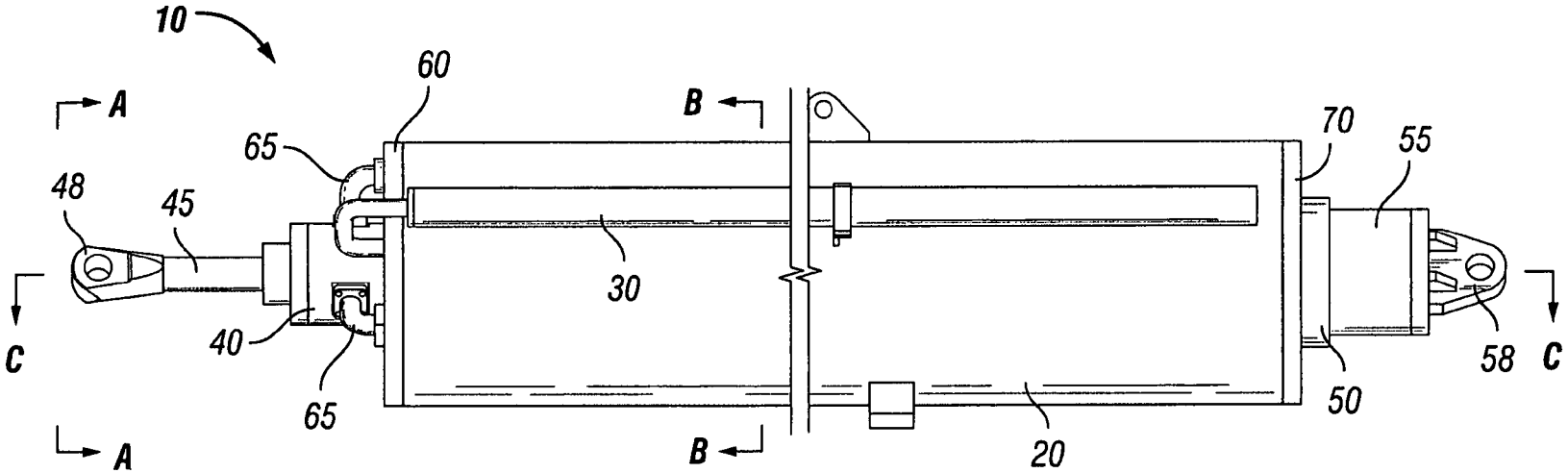
FIG. 2 is a side view of an inline compensator according to one embodiment of the present invention.

Referring now to FIG. 2, a side view of a typical inline compensator 10 according to a preferred embodiment of the present invention is shown. The inline compensator shown in FIG. 2 comprises a tubular housing 20 closed on both ends by end caps 60 and 70 that are connected to the tubular housing 20. FIG. 2 shows end caps 60 and 70 bolted to tubular housing 20; however, end caps 60 and 70 can be connected to tubular housing 20 by any suitable connection means capable of withstanding high pressures and capable of providing an air and fluid tight connection.

Figure 3:
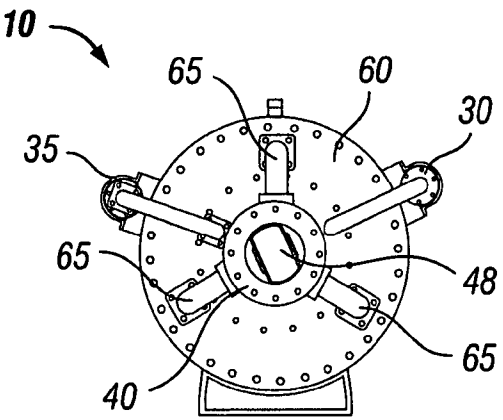
FIG. 3 is a view of the upward facing end of the inline compensator of FIG. 2 viewed along the line A—A shown in FIG. 2.

Running longitudinally along the length of the tubular housing 20 is a series of piping that comprises a low-pressure accumulator 30 and a low-pressure accumulator 35 (shown in FIG. 3). As shown in more detail with reference to FIG. 5, low-pressure accumulator 30 and low pressure accumulator 35 are in communication with the low-pressure side of piston head 90 and piston head 100 through end cap 60.

Figure 5:
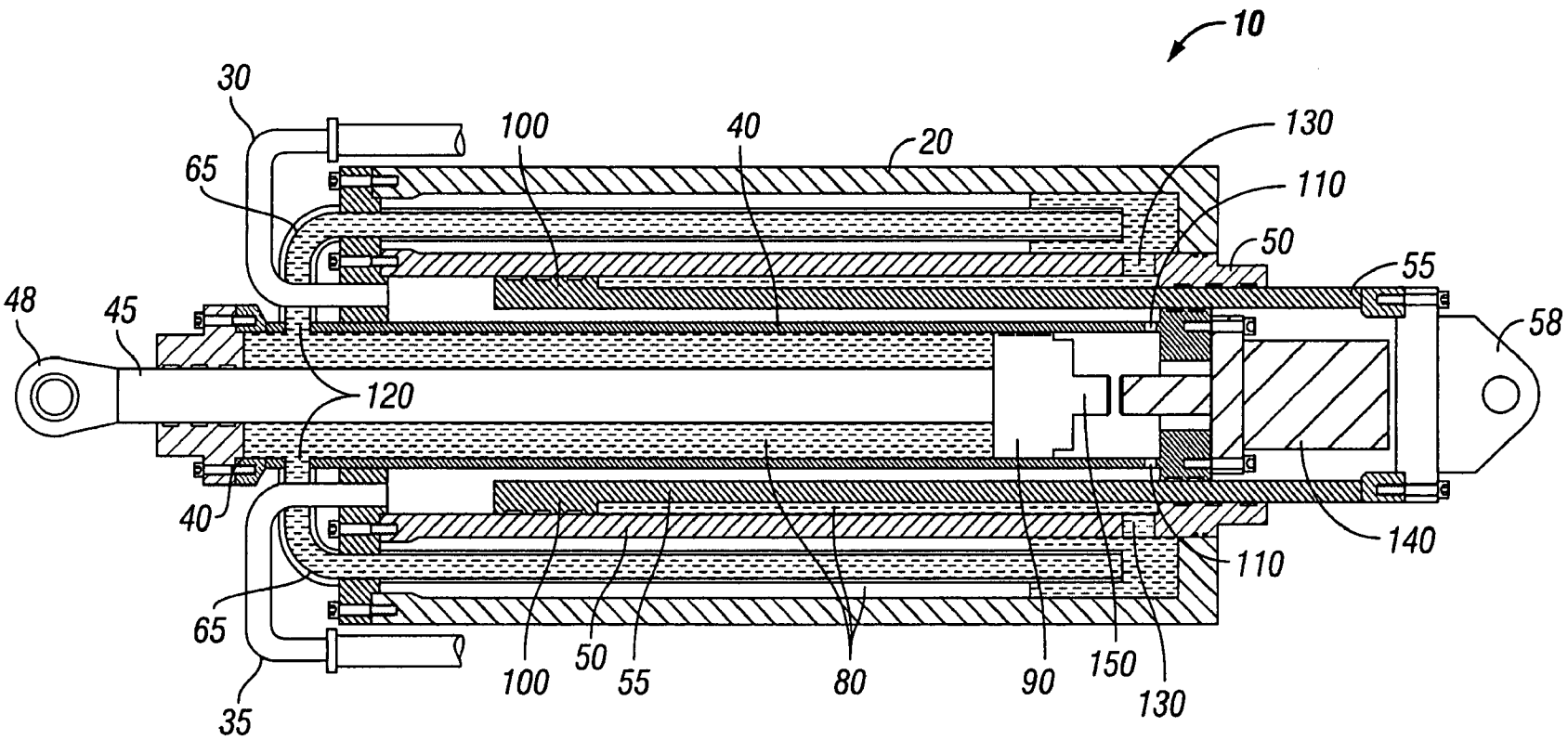
FIG. 5 is a vertical cross-sectional view of the inline compensator of FIG. 2 viewed along the line C—C shown in FIG. 2.

In the embodiment shown in FIG. 2, inner cylinder 40 extends into tubular housing 20 through end cap 60. Piston rod 45 runs longitudinally within inner cylinder 40 and, as shown in FIG. 5, is attached to piston head 90. Connecting lug 48 is connected to piston rod 45. Connecting lug 48 can be connected to piston rod 45 by any suitable connection means, including, but not limited to, threadably coupling connecting lug 48 to piston rod 45, welding connecting lug 48 to piston rod 45, pinning or bolting connecting lug 48 to piston rod 45, or connecting lug 48 may be integrally formed with piston rod 45. In use, connecting lug 48 connects inline compensator 10 in place on the floating drilling rig (as discussed in more detail with reference to FIGS. 12 through 14).

Similarly, inner cylinder 50 extends into tubular housing 20 through end cap 70. Piston rod 55 runs longitudinally within inner cylinder 50 and, as shown in FIG. 5, is attached to piston head 100. Connecting lug 58 is connected to piston rod 55. Connecting lug 58 can be connected to piston rod 55 by any suitable connection means, including, but not limited to, threadably coupling connecting lug 58 to piston rod 55, welding connecting lug 58 to piston rod 55, pinning or bolting connecting lug 58 to piston rod 55, or connecting lug 58 may be integrally formed with piston rod 55. In use, connecting lug 58 connects inline compensator 10 in place on the floating drilling rig (as discussed in more detail with reference to FIGS. 12 through 14).

FIG. 3 is a view of end cap 60 as viewed along the line A—A shown in FIG. 2. As can be seen in FIG. 3, the piping of low-pressure accumulators 30 and 35 passes through end cap 60 such that it enters tubular housing 20 and is in fluid communication with the low-pressure side of piston head 90 and piston head 100 inside tubular housing 20 (as shown in FIG. 5). The functioning of low-pressure accumulator 30 and low-pressure accumulator 35 will be discussed in more detail with reference to the operation of the inline compensator of the present invention.

FIGS. 2 and 3 also show low-pressure accumulator 30 and low-pressure accumulator 35 attached to the outer surface of tubular housing 20. Low-pressure accumulators 30 and 35 can be attached to tubular housing 20 in any manner capable of holding the accumulators fixed in place during the operation of the inline compensator. In the preferred embodiment, low-pressure accumulators 30 and 35 are attached to the outer surface of tubular housing 20 with pipe supports.

In alternative embodiments of the present invention, low-pressure accumulators 30 and 35 may also be housed within tubular housing 20, or one low-pressure accumulator may be housed within tubular housing 20 and one low-pressure accumulator may be attached to the outer surface of tubular housing 20. One of skill in the art will appreciate that, depending on the size of tubular housing 20 and the volume available within tubular housing 20, various combinations of the placement of low-pressure accumulators 30 and 35 may be used. However, it is an object of the present invention to provide an inline compensator that is self contained and, thus, low-pressure accumulators 30 and 35 should remain attached to or housed within the tubular housing 20. By providing an inline compensator that is self-contained, the present invention alleviates the need for additional space for separate, external accumulators to be placed on the drill floor and alleviates the need for additional piping to be run from external accumulators to the inline compensator. One of skill in the art will appreciate, however, that external accumulators can be used with the present invention without departing from the functioning of the inline compensator.

FIG. 3 also shows high-pressure accumulator piping 65 connected to inner cylinder 40 and passing through end cap 60 into tubular housing 20. As shown in more detail with reference to FIG. 5, high-pressure accumulator piping 65 allows for fluid communication between the high-pressure sides of piston head 90 and piston head 100 and the high-pressure accumulator 80 within tubular housing 20.

Figure 4:
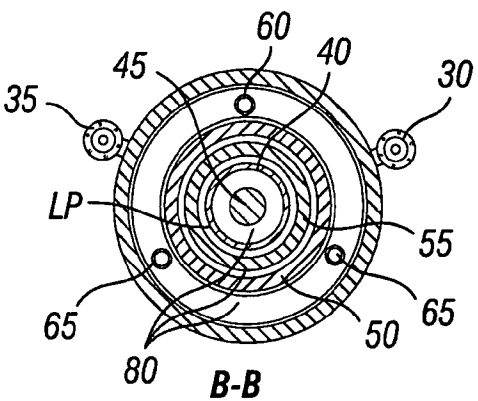
FIG. 4 is a horizontal cross-sectional view of the inline compensator of FIG. 2 viewed along the line B—B shown in FIG. 2.

FIG. 4 is a horizontal cross-sectional view of the inline compensator of FIG. 2 viewed along the line B—B shown in FIG. 2. As can be seen in FIG. 4, tubular housing 20 houses inner cylinder 40 and inner cylinder 50. Inner cylinder 40 contains piston rod 45 that extends through end cap 60 and is connected to connecting lug 48 (as discussed above). Similarly, inner cylinder 50 contains piston rod 55 that extends through end cap 70 and is connected to connecting lug 58 (as discussed above). As can be seen in FIG. 4 (and as shown in more detail with reference to FIG. 5), inner cylinder 40 has a smaller diameter and is centered within inner cylinder 50.

The open area surrounding inner cylinder 50 and the open area on the high-pressure side of piston heads 90 and 100 within inner cylinders 40 and 50 respectively are in fluid communication with each other and serve as a high-pressure accumulator 80, in a preferred embodiment of the present invention. The high-pressure accumulator 80 comprises hydraulic fluid filling a specified amount of this open volume inside tubular housing 20.

Similarly, the open area within inner cylinder 50 on the low-pressure side of piston head 100 is in communication with the open area within inner cylinder 40 on the low-pressure side of piston head 90. As discussed above, and as shown in more detail with reference to FIG. 5, the low pressure sides of piston heads 90 and 100 are in communication with low pressure accumulators 30 and 35.

FIG. 5 is a cross-sectional view of a preferred embodiment of inline compensator 10 viewed along the line C—C shown in FIG. 2. As can be seen in FIG. 5, piston head 90 is attached to (or integrally formed with) piston rod 45 inside inner cylinder 40. Similarly, piston head 100 is attached to (or integrally formed with) piston rod 55 inside inner cylinder 50. As discussed in more detail below with reference to FIGS. 15–17, the size of the piston heads define the piston area that, together with the accumulator pressure, controls the amount of force the pistons of the inner cylinders 40 and 50 can compensate for during the functioning of the inline compensator 10.

As can be seen in FIG. 5, low-pressure accumulators 30 and 35 are in communication with the low-pressure sides of the piston heads 90 and 100 contained within inner cylinders 40 and 50 respectively. The communication between the low-pressure side of piston head 90 and the low-pressure side of piston head 100 is facilitated by ports 110 in the wall of inner cylinder 40.

FIG. 5 also shows high-pressure accumulator piping 65 in fluid communication with the high-pressure sides of piston heads 90 and 100 via high-pressure accumulator 80. The fluid communication between the high-pressure side of piston head 90 and the high-pressure side of piston head 100 is facilitated through high-pressure accumulator piping 65 (via ports 120) and through ports 130 in the wall of inner cylinder 50.

In addition, to protect against piston head 90 striking the low-pressure end of inner cylinder 40 with too great a force when piston rod 45 retracts, the low-pressure end of inner cylinder 40 may be equipped with a hydraulic dampener 140. As shown in FIG. 5, if a hydraulic dampener 140 is used on inner cylinder 40, piston head 90 may have an extension rod 150 attached to it (or integrally formed with it) for striking hydraulic dampener 140.

Figure 6:
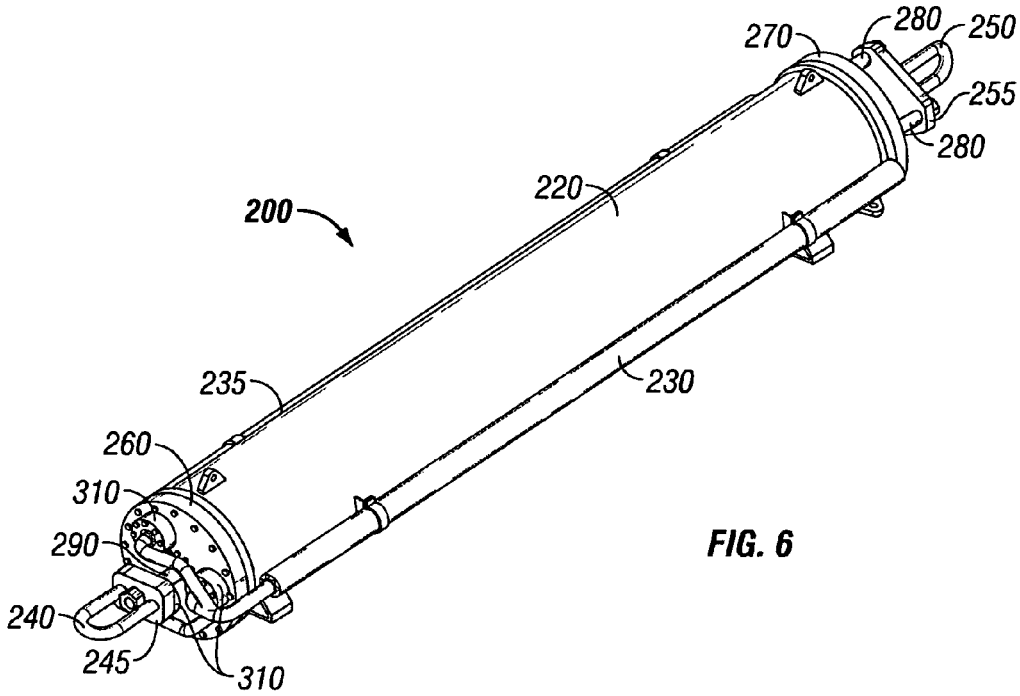
FIG. 6 is a three-dimensional layout view of an inline compensator according to one embodiment of the present invention.

Referring now to FIG. 6, a three-dimensional layout view of an alternative embodiment of inline compensator 200 is shown. The inline compensator shown in FIG. 6 comprises a tubular housing 220 closed on both ends by end caps 260 and 270 that are connected to the tubular housing 220. FIG. 6 shows end caps 260 and 270 bolted to tubular housing 220; however, end caps 260 and 270 can be connected to tubular housing 220 by any suitable connection means capable of withstanding high pressures and capable of providing an air and fluid tight connection.

Running longitudinally along the length of the tubular housing 220 is a series, of piping that comprises a low-pressure accumulator 230 and a low-pressure accumulator 235. In the embodiment of the present invention shown in FIG. 6, low-pressure accumulator 230 is in communication with a group of three inner cylinders 310 through end cap 260. Similarly, although not shown in FIG. 6, low-pressure accumulator 235 is in communication with a single inner cylinder 300 through end cap 270.

In the embodiment shown in FIG. 6, lug plate 245 is connected to a single piston rod 290 that extends into tubular housing 220 through end cap 260. U-shaped lug 240 is connected to lug plate 245. Lug 240 can be connected to lug plate 245 by any suitable connection means or may be integrally formed with lug plate 245. Similarly, lug plate 255 is connected to three piston rods 280 that extend into tubular housing 220 through end cap 270 (as shown in more detail in FIG. 7). U-shaped lug 250 is connected to lug plate 255. Lug 250 can be connected to lug plate 255 by any suitable connection means or may be integrally formed with lug plate 255.

Figure 7:
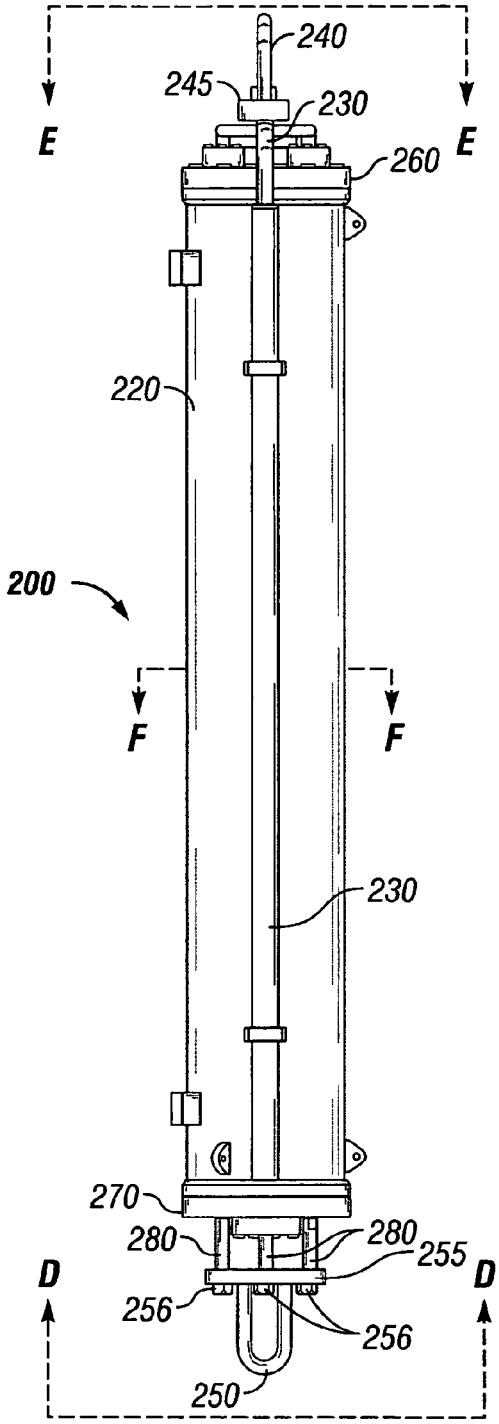
FIG. 7 is a side view of the inline compensator shown in FIG. 6.

FIG. 7 is a side view of the inline compensator 200 shown in FIG. 6. The connection of lug plate 255 to piston rods 280 is shown in more detail in FIG. 7. In the embodiment of the present invention shown in FIG. 7, piston rods 280 are connected to lug plate 255 by screwing fasteners 256 onto the threaded ends of piston rods 280 that extend through lug plate 255. In a similar fashion, piston rod 290 can be connected to lug plate 245. One of skill in the art will appreciate that piston rods 280 and piston rod 290 can be connected to lug plate 255 and lug plate 245 respectively by any suitable connection means capable of withstanding the high tensile forces imparted on the piston rods during operation of the inline compensator.

Figure 8:
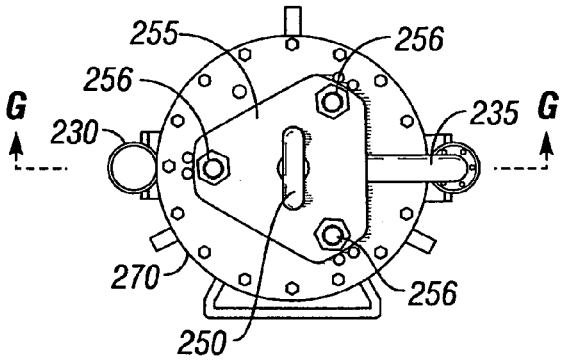
FIG. 8 is a view of the downward facing end of the inline compensator of FIG. 7 viewed along the line D—D shown in FIG. 7.

FIG. 8 is a view of end cap 270 as viewed along the line D—D shown in FIG. 7. As can be seen in FIG. 8, lug plate 255 is connected to lug 250 and is specially shaped such that lug plate 255 can be attached to the multiple piston rods 280 (numbering three as shown in FIG. 7) via fasteners 256.

FIG. 8 also shows the piping of low-pressure accumulator 235 passing underneath lug plate 250 such that it can be connected to the end of inner cylinder 300 through end cap 270. The functioning of low-pressure accumulator 235 and low-pressure accumulator 230 will be discussed in more detail with reference to the operation of the inline compensator of the present invention.

Figure 9:
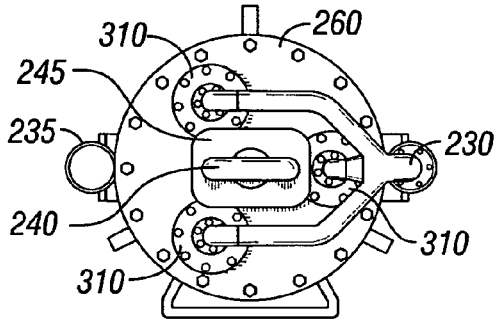
FIG. 9 is a view of the upward facing end of the inline compensator of FIG. 7 viewed along the line E—E shown in FIG. 7.

FIG. 9 is a view of end cap 260 as viewed along the line E—E shown in FIG. 7. Lug plate 245 is connected to lug 240 and, although not shown, is connected to the single piston rod 290 (as shown in FIG. 6). FIG. 9 also shows the piping of low-pressure accumulator 230 connected to the ends of inner cylinders 310 through end cap 260.

Figure 10:
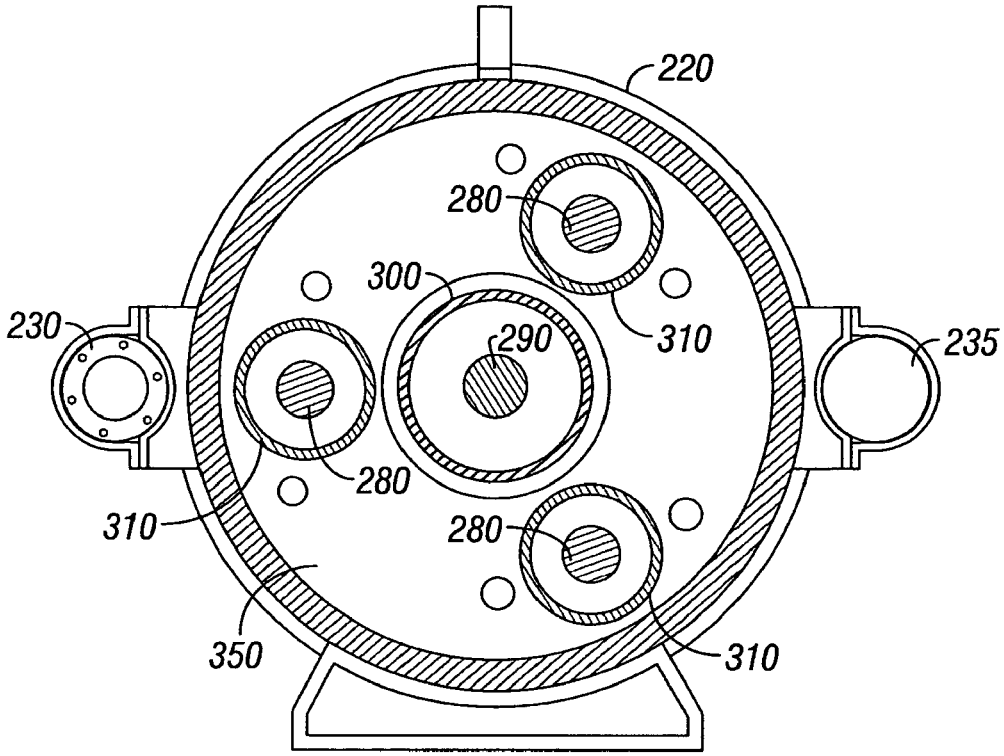
FIG. 10 is a horizontal cross-sectional view of the inline compensator of FIG. 7 viewed along the line F—F shown in FIG. 7.

FIG. 10 is a cross-sectional view of the embodiment of the inline compensator 200 viewed along the line F—F shown in FIG. 7. As can be seen in FIG. 10, tubular housing 220 houses a plurality of individual cylinders—single inner cylinder 300 and a group of three smaller inner cylinders 310. Inner cylinder 300 contains piston rod 290 that extends through end cap 260 and is connected to lug plate 245 (as discussed above). Similarly, the three inner cylinders 310 contain piston rods 280 that extend through end cap 270 and are connected to lug plate 255 (as discussed above).

The open area surrounding the inner cylinders 300 and 310 shown in FIG. 10 serves as a high-pressure accumulator 350. The high-pressure accumulator 350 comprises hydraulic fluid filling a specified amount of the open volume of the inside of tubular housing 220. The high-pressure accumulator 350 is in fluid communication with the high-pressure side of the pistons within inner cylinders 300 and 310 (as shown by the block diagram of the functioning of the inline compensator shown in FIG. 15). In alternative embodiments of the present invention, the high-pressure accumulator may comprise separate, individual accumulators for each inner cylinder or inner cylinder group. One of skill in the art will appreciate that various configurations for the high-pressure accumulator may be used without departing from the objects of the present invention.

FIG. 10 also shows low-pressure accumulator 230 and low-pressure accumulator 235 attached to the outer surface of tubular housing 220. Low-pressure accumulators 230 and 235 may be attached to tubular housing 220 in any manner capable of holding the accumulators fixed in place during the operation of the inline compensator. The preferred method of attaching low-pressure accumulators 230 and 235 to the outer surface of tubular housing 220 is with pipe supports.

As noted above, alternative embodiments of the present invention may utilize low-pressure accumulators 230 and 235 housed within tubular housing 220, or one low-pressure accumulator may be housed within tubular housing 220 and one low-pressure accumulator will be attached to the outer surface of tubular housing 220. One of skill in the art will appreciate that, depending on the size of tubular housing 220 and the volume available within tubular housing 220, various combinations of the placement of low-pressure accumulators 230 and 235 may be used.

Figure 11:
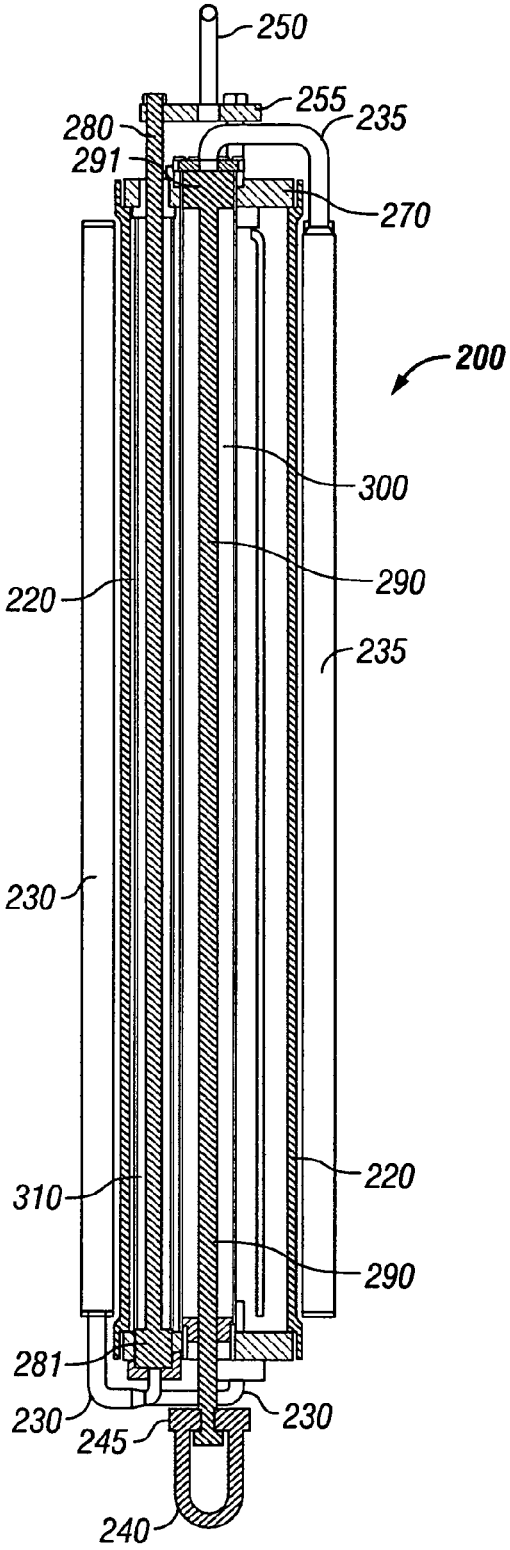
FIG. 11 is a vertical cross-sectional view of the inline compensator of FIG. 7 viewed along the line G—G shown in FIG. 8.

FIG. 11 is a cross-sectional view of inline compensator 200 viewed along the line G—G shown in FIG. 8. As can be seen in FIG. 11, piston head 291 is attached to (or integrally formed with) piston rod 290 inside inner cylinder 300. Similarly, piston heads 281 are attached to (or integrally formed with) piston rods 280 inside inner cylinders 310. As discussed in more detail below with reference to FIGS. 15–17, the size of the piston heads define the piston area that, together with the accumulator pressure, controls the amount of force the pistons of the inner cylinders 300 and 310 can compensate for during the functioning of the inline compensator 200. FIG. 11 also shows the connection of low-pressure accumulators 230 and 235 to the low-pressure sides of the pistons contained within inner cylinders 300 and 310.

Although the embodiments of the present invention discussed herein utilize one larger inner cylinder and one smaller inner cylinder (FIGS. 2 through 5) or one larger inner cylinder and a group of three smaller inner cylinders (FIGS. 6 through 11), the number and size of the inner cylinders housed within tubular housing 20 or 220 can vary depending on the application—as discussed in more detail below with reference to FIGS. 12–17.

Functioning Of the Inline Compensator

Having described the components of the inline compensator of the present invention, the functioning of the inline compensator will be described with reference to FIGS. 12 through 17. The functioning of the inline compensator of the present invention will be described with reference to the embodiment utilizing one larger inner cylinder and a group of three smaller inner cylinders (FIGS. 6 through 11).

Figure 12:
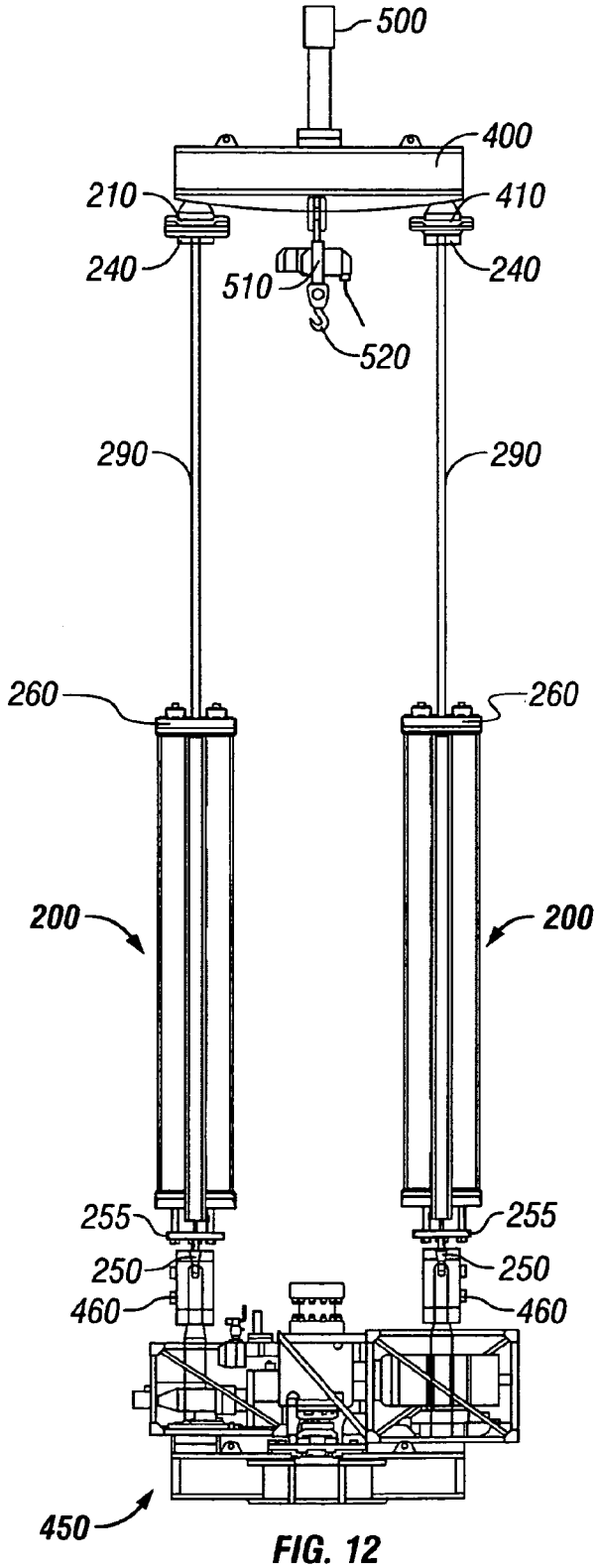
FIG. 12 shows a pair of typical inline compensators according to one embodiment of the present invention installed between the hoisting frame and the production head (or surface tree) of a typical floating drilling rig.
Figure 13:
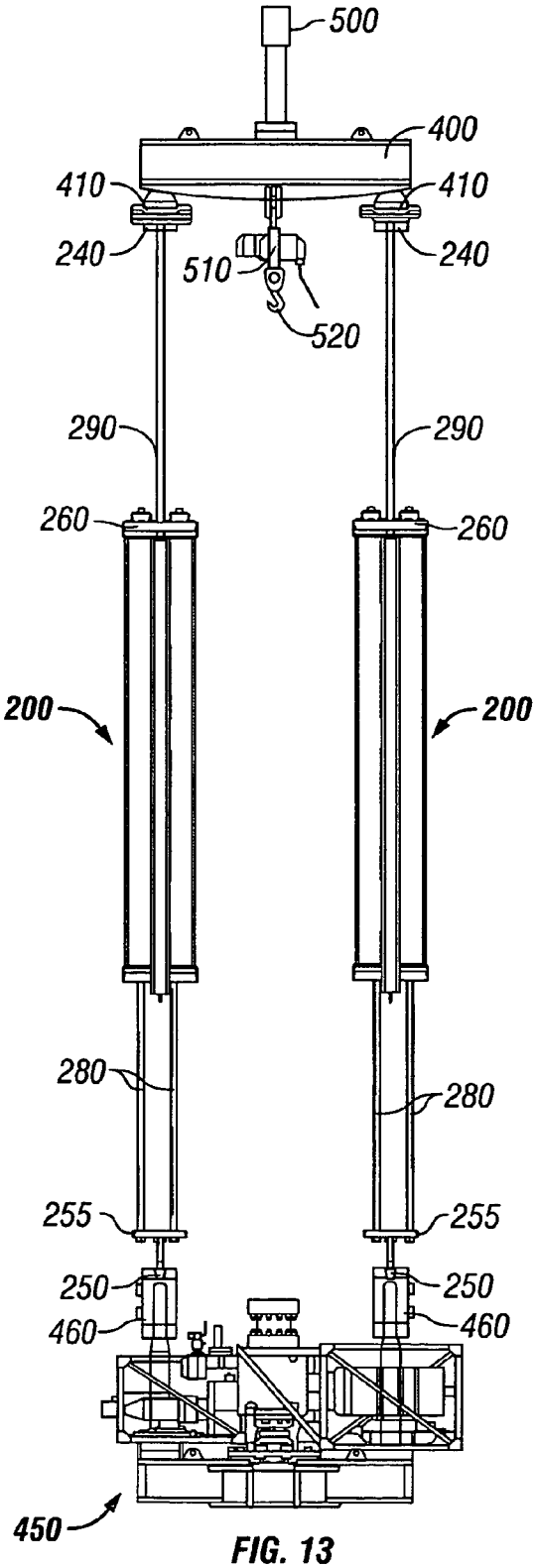
FIG. 13 shows the inline compensators of FIG. 12 in the fully extended position. The inline compensators shown in FIG. 13 are functioning in place of the inoperative primary heave compensation system and are fully extended to account for the rise of the floating drilling rig as it rides to the crest of a wave.
Figure 14:
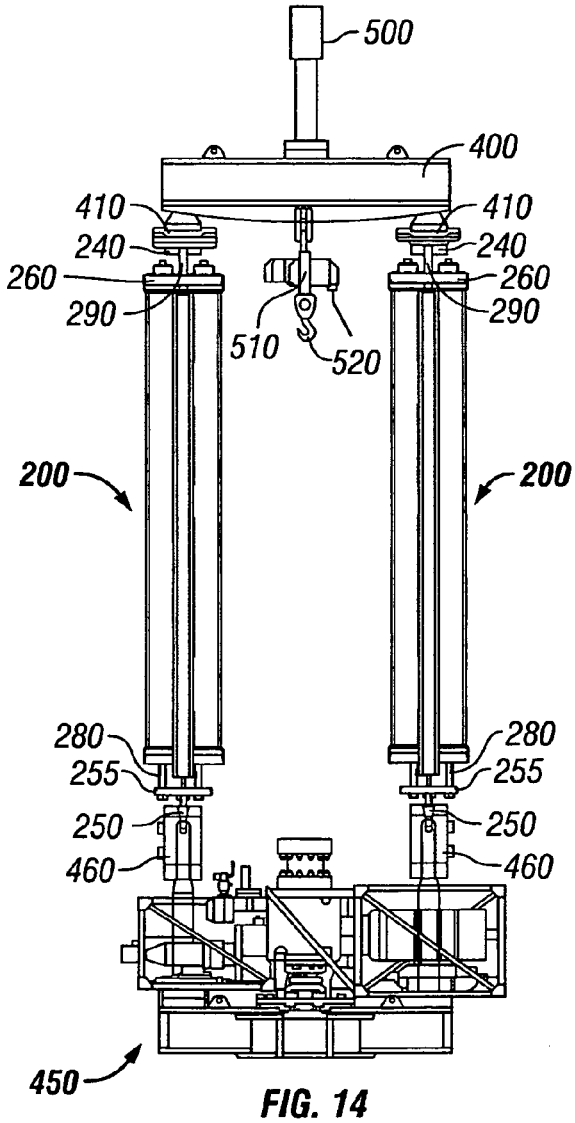
FIG. 14 shows the inline compensators of FIG. 12 in the fully retracted position. The inline compensators shown in FIG. 14 are functioning in place of the inoperative primary heave compensation system and are fully retracted to account for the lowering of the floating drilling rig as it rides down into the trough between waves.

Specifically, with reference to FIGS. 12 through 14, a pair of inline compensators 200 in accordance with one embodiment of the present invention is shown installed between the hoisting frame 400 (which is connected between pipe sub 500 and hoist 510) and the production head 450 of a typical floating drilling rig that is set up for an early production arrangement. Installed in this way, the inline compensators 200 are hanging above the drill floor of the floating drilling rig.

As can be seen in FIG. 12, lugs 250 of the inline compensators 200, are connected to the production head 450 via connecting means 460. Similarly, lugs 240 of the inline compensators 200 are connected to the hoisting frame 400 via connecting means 410. In the position shown in FIG. 12, piston rods 290 are fully extended, while piston rods 280 are fully retracted. In the fully extended position, piston rods 290 are extended above end cap 260 approximately 6 meters. One of skill in the art will appreciate that the extension—or "stroke"—of piston rods 290 can be increased or decreased depending on the application for which the inline compensators are used. As will be discussed below with reference to FIGS. 16–17, the position shown in FIG. 12 represents the "static" operating position of the inline compensators 200—i.e., the position where the primary heave compensation system is functioning properly.

FIGS. 13 and 14 depict the inline compensators 200 in the "operational mode"—i.e., the inline compensators 200 are now functioning due to the primary heave compensation system becoming inoperative. With reference to FIG. 13, the piston rods 280 of the inline compensators 200 are shown fully extended. In this position, the floating drilling rig has ridden up to the crest of a wave, necessitating the need for piston rods 280 to extend. In the extended position, piston rods 280 extend approximately 6 meters and, thus, can accommodate a 6 meter rise in the floating drilling rig due to heave. One of skill in the art will appreciate that the extension—or "stroke"—of piston rods 280 can be increased or decreased depending on the application for which the inline compensators are used.

With reference to FIG. 14, both piston rods 290 and piston rods 280 are in their fully retracted position. In this position, the floating drilling rig has ridden down into the trough between waves, necessitating the need for the piston rods to retract. Given the 6 meter extended length of both piston rods 280 and 290 (shown in FIG. 13), the inline compensators 200 are able to accommodate a 12 meter difference between a wave's crest and the trough between waves as the floating drilling rig heaves.

Figure 15:
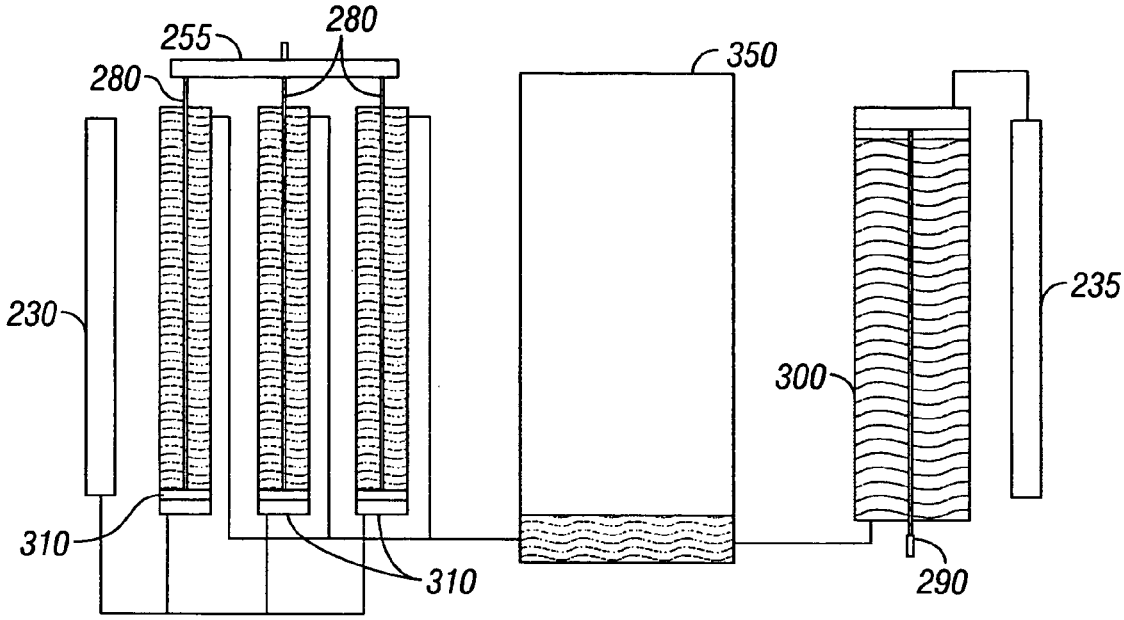
FIG. 15 is a block diagram showing how the cylinders and accumulators of the inline compensator according to one embodiment of the present invention function together to compensate for heave during operation of the inline compensator.
Figure 16:
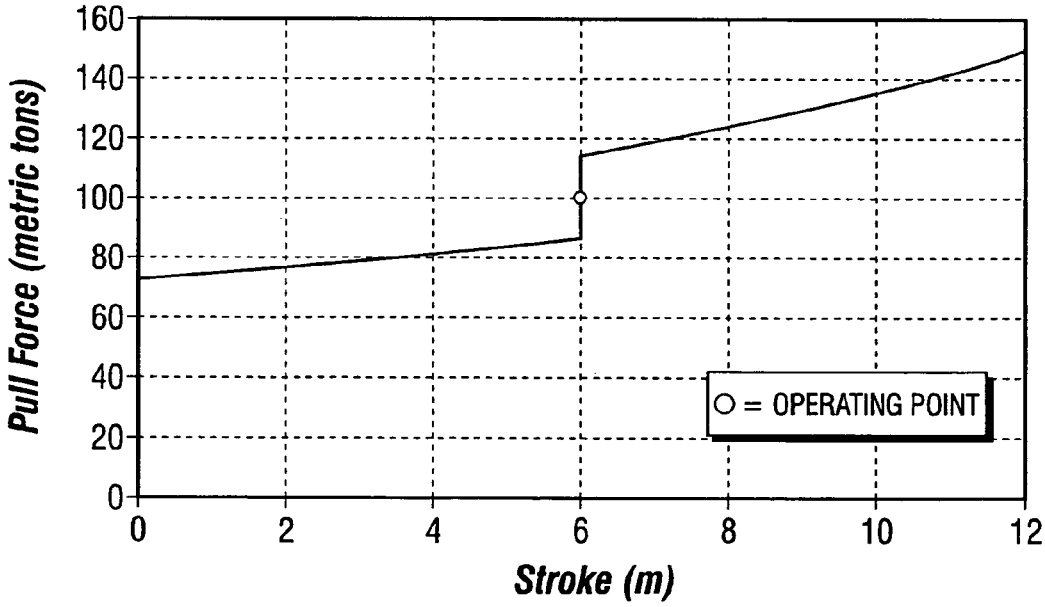
FIG. 16 is a graph showing the relationship between the stroke length of the pistons of a typical inline compensator versus the pull force on the piston rods during operation of the inline compensator according to one embodiment of the present invention.
Figure 17:
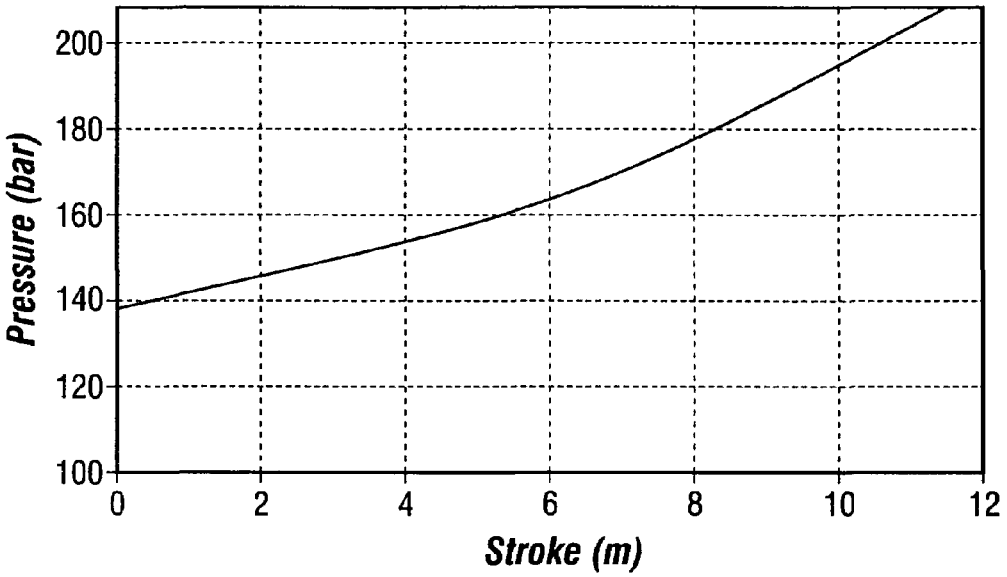
FIG. 17 is a graph showing the pressure within the cylinders and within the common accumulator of a typical inline compensator versus the stroke length of the pistons during operation of the inline compensator according to one embodiment of the present invention.

Referring now to FIGS. 15 through 17, a more detailed discussion of the functioning of the inline compensator of the present invention is provided. In operation, the typical inline compensator of the present invention is a passive, hydraulic system with two or more cylinders or cylinder groups working "back-to-back." That is, when the primary heave compensation system works as normal, the inline compensator will only be a static system. If the primary heave compensation system fails, the inline compensator of the present invention will function to compensate for heave of the floating drilling rig.

In the embodiment of the inline compensator discussed with reference to FIGS. 15 through 17, the inline compensator comprises a total of four hydraulic cylinders—the inner cylinders 300 and 310 shown in FIG. 10. In operation, the piston of "cylinder 1"—shown as inner cylinder 300 in FIG. 10—works in one direction, while the three pistons of "cylinder group 2"—shown as inner cylinders 310 in FIG. 10—work in the opposite direction. Additionally, the piston area inside the two cylinder combinations is different. The total piston area of cylinder group 2 is greater than the piston area of the single piston of cylinder 1.

The piston rod side—or high-pressure side—of the pistons in cylinder 1 and cylinder group 2 are fluidly connected together in a closed loop hydraulic system with a common high-pressure accumulator (shown as 350 on FIG. 10). As such, at the "operating point" shown in FIGS. 16 and 17, the pressure on the piston rod side of the pistons in cylinder 1 and cylinder group 2 will be the same. The piston head—or low-pressure side—of the pistons is referred to as the "air" or "gas" side of the pistons.

By way of example, FIGS. 16 and 17 graphically depict the functioning of the inline compensator in accordance with the embodiment shown in FIGS. 12 through 14. The closed-loop hydraulic system of the inline compensators is "pre-charged" to a defined pressure determined by the specific application. For the given application shown in FIGS. 16 and 17, the pre-charge pressure of the hydraulic system will correspond to a pull force of approximately 70 metric tons, and the tension on the production tubing is assumed to be approximately 100 metric tons. At this pre-charge pressure, the piston rods of both cylinder 1 and cylinder group 2 will be fully retracted.

To place the inline compensators in the static mode shown in FIG. 12, the piston rods 290 of cylinder 1 are extended by applying a pull force on the rods. When the pull force on the piston rods 290 has reached approximately 85 metric tons, the piston rods 290 of cylinder 1 are fully extended. Once the inline compensators are installed and ready for operation, the inline compensators will act as a static system between approximately 85 metric tons and 115 metric tons. This static force range is known as the "working range"—i.e., the range in which the primary heave compensation system is functioning properly and the inline compensator is static. As long as the pull force on the inline compensators remains in the range between 85–115 metric tons, the piston rods of cylinder 1 will remain fully extended and the piston rods of cylinder group 2 will remain fully retracted. This working range is shown on FIG. 16 as a vertical line.

If the primary heave compensation system fails, the inline compensator begins to work. While the floating drilling rig is riding up a wave, the tension on the production tubing—and therefore the pull force on the inline compensator—will increase to 115 metric tons and higher. At approximately 115 metric tons, the piston rods of cylinder group 2 begin to extend and continue until they are fully extended (resulting in a total "extension" of 12 meters for the inline compensators) at approximately 145 metric tons (as shown in FIG. 16).

As the floating drilling rig rides down into the trough between waves, the tension on the production tubing—and therefore the pull force on the inline compensator—will decrease. As the pull force on the inline compensator decreases, the piston rods of cylinder group 2 retract. When the pull force decreases to approximately 115 metric tons, piston rods of cylinder group 2 are fully retracted. As the pull force continues to decrease below approximately 85 metric tons, the piston rods of cylinder 1 will also retract to account for the rig at the bottom of the trough. When the pull force decreases to approximately 70 metric tons, the piston rod of cylinder 1 is fully retracted (resulting in a total "extension" of 0 meters for the inline compensator). The cycle of the expanding and retracting of the piston rods of the inline compensator continues as necessary to account for the frequency of the waves encountered by the floating drilling rig.

With reference to FIG. 17, the pressure on the high-pressure side of the pistons of cylinder 1 and cylinder group 2 and the pressure inside the high-pressure accumulator is shown as a function of the extension—or stroke—of the piston rods. Viewing FIG. 17 and FIG. 15 together shows how the high-pressure accumulator 350, or common accumulator, functions with the pistons of the inline compensator during operation. Specifically, as the piston rod of cylinder 1 extends as the pull force on the rod increases, the pressure on the fluid side of the piston of cylinder 1 increases, forcing fluid into the common accumulator and, thus, increasing the pressure in the common accumulator. In the example discussed herein, at the fully retracted position, the fluid pressure in the cylinders and in the common accumulator is approximately 138 bars (refer to FIG. 17).

As the pull force on the piston rod of cylinder 1 increases, the fluid pressure in all cylinders and the common accumulator increases to approximately 163 bars at the fully extended position of the cylinder 1 piston rod. If the pull force on the inline compensator continues to increase (due to a failure of the primary heave compensation system), the piston rods of cylinder group 2 will extend, causing the pressure on the fluid side of the pistons in all cylinders and the fluid pressure in the common accumulator to increase. In the example discussed herein, at the fully extended position, the fluid pressure in all cylinders and in the common accumulator increases to approximately 207 bars (refer to FIG. 17).

The increased pull force that can be applied to the piston rods of cylinder group 2 is attributable to the increased total piston area of cylinder group 2. As discussed above, the embodiment of the inline compensator shown in FIG. 10 has one large inner cylinder 300 (cylinder 1) and three smaller inner cylinders 310 (cylinder group 2) housed in tubular housing 220. The area of the piston in cylinder 1 is smaller than the combined piston area of the pistons in cylinder group 2. This difference allows the piston rods of cylinder group 2 to remain retracted until higher pull forces are reached. It is this piston area difference between the two cylinder groups coupled with the pressure within the common accumulator that determines the working range of the inline compensator.

Although the operating point for the example inline compensators discussed herein is 100 metric tons (as shown on FIG. 16), one of skill in the art will appreciate that this operating point can be changed by varying several factors, including the number of cylinders, the size of the piston rods, and the diameter of the pistons. Additionally, although the embodiments of the inline compensator discussed herein comprise a single larger inner cylinder and a single smaller inner cylinder (FIGS. 2 through 5) or a single larger inner cylinder and three smaller inner cylinders (FIGS. 6 through 11), one of skill in the art will appreciate that alternative embodiments may utilize two and two cylinders, two and three cylinders, or any combination that is required for the given application. For example, in alternative embodiments used in deep water operations, the inline compensator of the present invention can be made with varying cylinder sizes and numbers to provide for a higher force working range through increased pressure difference between the two cylinder groups.

Further, the stroke of the preferred embodiment of the inline compensator is ±6 meters (12 meters total). One of skill in the art will appreciate that this stroke length can be adjusted by changing the length of the piston rods and cylinders. By allowing varying stroke lengths, the customer can control the stroke length to fit its given application and size limitations.

Also, although the discussion herein with regard to FIGS. 12 through 17 is in reference to a pair of inline compensators working together, a typical application will have a single inline compensator installed directly to the production head on the floating drilling rig. One inline compensator cannot be used in applications in which coiled tubing operations will be conducted, however, because the coiled tubing injector head must be installed directly above the production tree. By using two inline compensators of the present invention, it allows operators to provide a back-up heave compensation system that still allows you to conduct coiled tubing operations. In particular, by using two smaller compensators of the present invention as shown in FIGS. 12–14, an operator will still have space and height for the injector head to be installed in between the two compensators.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

The invention claimed is:

1. An inline compensator apparatus for a floating vessel comprising:

an outer housing sealed on both ends by end caps;

a first inner cylinder housed at least partially within the outer housing, the first inner cylinder having a first diameter and having a piston head and a piston rod therein;

a second inner cylinder housed at least partially within the outer housing, the second inner cylinder having a second diameter and having a piston head and a piston rod therein, wherein the cross-sectional area of the piston head of the first inner cylinder is greater than the cross-sectional area of the piston head of the second inner cylinder, wherein the piston rod of the first inner cylinder extends through an end cap of the outer housing and has a connecting lug on the end of the piston rod outside the outer housing, wherein the piston rod of the second inner cylinder extends through the other end cap of the outer housing and has a connecting lug on the end of the piston rod outside the outer housing, wherein the inline compensator apparatus is operable with the floating vessel's hoisting system such that the piston rods can be extended and retracted to account for heave of the floating vessel;

one or more low pressure accumulators in communication with the low pressure side of the piston heads of both the first and second inner cylinders; and a high pressure accumulator in communication with the high pressure side of the piston heads of both the first and second inner cylinders, the high pressure accumulator comprising the open volume surrounding the inner cylinders within the outer housing.

2. The inline compensator apparatus of claim 1 wherein the first inner cylinder passes through an end cap of the outer housing.

3. The inline compensator apparatus of claim 1 wherein the second inner cylinder passes through an end cap of the outer housing.

4. The inline compensator apparatus of claim 1 wherein piping of the one or more low pressure accumulators passes through an end cap of the outer housing.

5. The inline compensator apparatus of claim 1 wherein piping of the high pressure accumulator passes through an end cap of the outer housing.

6. The inline compensator apparatus of claim 1 wherein the one or more low pressure accumulators are attached to the outer surface of the outer housing.

7. The inline compensator apparatus of claim 6 wherein the one or more low pressure accumulators are attached to the outer surface of the outer housing by pipe supports.

8. The inline compensator apparatus of claim 1 wherein the one or more low pressure accumulators are housed at least partially within the outer housing.

9. The inline compensator apparatus of claim 1 wherein one or more of the low pressure accumulators is attached to the outer surface of the outer housing and one or more of the low pressure accumulators is housed within the outer housing.

10. The inline compensator apparatus of claim 1 further comprising the low pressure end of the first inner cylinder having a hydraulic dampener.

11. The inline compensator apparatus of claim 10 wherein the piston head within the first inner cylinder has an extension rod for striking the hydraulic dampener.

12. The inline compensator apparatus of claim 1 wherein the connecting lugs are attached to the piston rods.

13. The inline compensator apparatus of claim 1 wherein the connecting lugs are integrally formed as part of the piston rods.

14. The inline compensator apparatus of claim 1 wherein the inline compensator is normally static but becomes operative if a primary heave compensation system on the floating vessel becomes inoperative.

15. An inline compensator apparatus for a floating vessel comprising:

an outer housing sealed on both ends by end caps;

an inner cylinder of a first diameter housed at least partially within the outer housing, the inner cylinder having a piston head and a piston rod therein;

a plurality of inner cylinders of a second diameter housed at least partially within the outer housing, the plurality of inner cylinders each having a piston head and a piston rod therein, wherein the plurality of inner cylinders are spaced about the circumference of the inner cylinder of a first diameter, wherein the total cross-sectional area of the piston heads of the plurality of inner cylinders is greater than the cross-sectional area of the piston head of the inner cylinder of a first diameter, wherein the piston rod of the inner cylinder of a first diameter extends through an end cap of the outer housing and has a connecting lug on the end of the piston rod outside the outer housing, wherein the piston rods of the plurality of inner cylinders extend through the other end cap of the outer housing and each have a connecting lug on the end of the piston rod outside the outer housing, wherein the inline compensator apparatus is operable with the floating vessel's hoisting system such that the piston rods can be extended and retracted to account for heave of the floating vessel;

one or more low pressure accumulators in communication with the low pressure side of the piston heads of both the inner cylinder of a first diameter and the plurality of inner cylinders; and a high pressure accumulator in communication with the high pressure side of the piston heads of both the inner cylinder of a first diameter and the plurality of inner cylinders, the high pressure accumulator comprising the open volume surrounding the inner cylinders within the outer housing.

16. The inline compensator apparatus of claim 15 wherein the inner cylinder of a first diameter passes through an end cap of the outer housing.

17. The inline compensator apparatus of claim 15 wherein the plurality of inner cylinders passes through an end cap of the outer housing.

18. The inline compensator apparatus of claim 15 wherein piping of the one or more low pressure accumulators passes through an end cap of the outer housing.

19. The inline compensator apparatus of claim 15 wherein piping of the high pressure accumulator passes through an end cap of the outer housing.

20. The inline compensator apparatus of claim 15 wherein the one or more low pressure accumulators are attached to the outer surface of the outer housing.

21. The inline compensator apparatus of claim 20 wherein the one or more low pressure accumulators are attached to the outer surface of the outer housing by pipe supports.

22. The inline compensator apparatus of claim 15 wherein the one or more low pressure accumulators are housed at least partially within the outer housing.

23. The inline compensator apparatus of claim 15 wherein one or more of the low pressure accumulators is attached to the outer surface of the outer housing and one or more of the low pressure accumulators is housed at least partially within the outer housing.

24. The inline compensator apparatus of claim 15 wherein the connecting lugs are attached to the piston rods.

25. The inline compensator apparatus of claim 15 wherein the connecting lugs are integrally formed as part of the piston rods.

26. The inline compensator apparatus of claim 15 wherein the inline compensator is normally static but becomes operative if a primary heave compensation system on the floating vessel becomes inoperative.

27. An inline compensator apparatus for a floating vessel comprising:

an outer housing;

one or more upwardly facing inner cylinders housed at least partially within the outer housing, the one or more upwardly facing inner cylinders having a first diameter and having a piston head and a piston rod therein;

one or more downwardly facing inner cylinders housed at least partially within the outer housing, the one or more downwardly facing inner cylinders each having a second diameter and having a piston head and a piston rod therein, wherein the total cross-sectional area of the piston heads of the one or more downwardly facing inner cylinders is greater than the total cross-sectional area of the piston heads of the one or more upwardly facing inner cylinders;

wherein the piston rods of the one or more downwardly facing inner cylinders extend downwardly and the piston rods of the one or more upwardly facing inner cylinders extend upwardly such that the piston rods can be extended and retracted to account for heave of the floating vessel;

one or more low pressure accumulators in communication with the low pressure side of the piston heads of both the upwardly and downwardly facing inner cylinders; and one or more high pressure accumulators in communication with the high pressure side of the piston heads of both the upwardly and downwardly facing inner cylinders.

28. The inline compensator apparatus of claim 27 wherein the outer housing is sealed on both ends by end caps.

29. The inline compensator apparatus of claim 28 wherein the one or more downwardly facing inner cylinders pass through an end cap of the outer housing.

30. The inline compensator apparatus of claim 28 wherein the one or more upwardly facing inner cylinders pass through an end cap of the outer housing.

31. The inline compensator apparatus of claim 28 wherein the piston rods of the one or more upwardly facing inner cylinders pass through one of the end caps of the outer housing and the piston rods of the one or more downwardly facing inner cylinders pass through the other end cap of the outer housing.

32. The inline compensator apparatus of claim 31 wherein the ends of the piston rods of the one or more upwardly facing inner cylinders that extend through the end cap each have a means for connecting the inline compensator apparatus to hoisting equipment on the floating vessel.

33. The inline compensator apparatus of claim 32 wherein the means for connecting the inline compensator to hoisting equipment on the floating vessel is attached to the piston rods.

34. The inline compensator apparatus of claim 32 wherein the means for connecting the inline compensator to hoisting equipment on the floating vessel is integrally formed as part of the piston rods.

35. The inline compensator apparatus of claim 32 wherein the ends of the piston rods of the one or more downwardly facing inner cylinders that extend through the end cap each have a means for connecting the inline compensator apparatus to equipment for supporting tubulars from the floating vessel.

36. The inline compensator apparatus of claim 35 wherein the means for connecting the inline compensator to equipment for supporting tubulars from the floating vessel is attached to the piston rods.

37. The inline compensator apparatus of claim 35 wherein the means for connecting the inline compensator to equipment for supporting tubulars from the floating vessel is integrally formed as part of the piston rods.

38. The inline compensator apparatus of claim 35 wherein the means for connecting connects the inline compensator apparatus between a hoisting frame and a production head on a floating drilling rig.

39. The inline compensator apparatus of claim 28 wherein piping of the one or more low pressure accumulators passes through an end cap of the outer housing.

40. The inline compensator apparatus of claim 28 wherein piping of the one or more high pressure accumulator passes through an end cap of the outer housing.

41. The inline compensator apparatus of claim 27 wherein the one or more low pressure accumulators are attached to the outer surface of the outer housing.

42. The inline compensator apparatus of claim 41 wherein the one or more low pressure accumulators are attached to the outer surface of the outer housing by pipe supports.

43. The inline compensator apparatus of claim 27 wherein the one or more low pressure accumulators are housed at least partially within the outer housing.

44. The inline compensator apparatus of claim 27 wherein one or more of the low pressure accumulators is attached to the outer surface of the outer housing and one or more of the low pressure accumulators is housed at least partially within the outer housing.

45. The inline compensator apparatus of claim 27 wherein the one or more high pressure accumulators comprises the open space surrounding the inner cylinders within the outer housing.

46. The inline compensator apparatus of claim 27 wherein the one or more high pressure accumulators comprises external accumulators attached to the outer surface of the outer housing.

47. The inline compensator apparatus of claim 27 wherein the inline compensator is normally static, but becomes operative if a primary heave compensation system on the floating vessel becomes inoperative.

48. A method of compensating for heave of a floating vessel comprising:

providing a heave compensation system having an outer housing sealed on both ends by end caps, the outer housing at least partially housing a first inner cylinder and a second inner cylinder;

providing each of the first and second inner cylinders with a piston head and a piston rod therein, wherein the cross-sectional area of the piston head of the first inner cylinder is greater than the cross-sectional area of the piston head of the second inner cylinder, and wherein each of the piston rods of the first and second inner cylinders extend through an end cap of the outer housing and have a connecting lug on the end of the piston rod outside the outer housing;

providing one or more low pressure accumulators in communication with the low pressure side of the piston heads of both the first and second inner cylinders;

providing a high pressure accumulator in communication with the high pressure side of the piston heads of both the first and second inner cylinders, the high pressure accumulator comprising the open volume surrounding the inner cylinders within the outer housing;

positioning the outer housing such that the piston rod of the first inner cylinder extends upwardly and the piston rod of the second inner cylinder extends downwardly;

connecting the inline compensator apparatus such that it is operable with the floating vessel's hoisting system;

allowing the piston rods of the first and second inner cylinders to extend and retract to account for heave of the floating vessel.

49. The method of claim 48 wherein the piston rod of the second inner cylinder is normally extended when the heave compensation system is in the static mode.

50. The method of claim 49 wherein the piston rod of the first inner cylinder is normally retracted when the heave compensation system is in the static mode.

51. The method of claim 48 wherein the piston rod of the first inner cylinder is extended to account for the rise of the floating vessel to the crest of a wave when the heave compensation system is operational.

52. The method of claim 51 wherein the piston rod of the second inner cylinder is retracted to account for the floating vessel riding down to the trough between waves when the heave compensation system is operational.

53. The method of claim 52 wherein the piston rod of the first inner cylinder is retracted to account for the floating vessel riding down to the trough between waves when the heave compensation system is operational.

54. A method of compensating for heave of a floating vessel comprising:

providing a heave compensation system having an outer housing sealed on both ends by end caps, the outer housing at least partially housing an inner cylinder of a first diameter and a plurality of inner cylinders of a second diameter;

providing each of the inner cylinders with a piston head and a piston rod therein, wherein the total cross-sectional area of the piston heads of the plurality of inner cylinders of a second diameter is greater than the cross-sectional area of the piston head of the inner cylinder of a first diameter, and wherein each of the piston rods of the inner cylinders extend through an end cap of the outer housing and have a connecting lug on the end of the piston rod outside the outer housing;

providing one or more low pressure accumulators in communication with the low pressure side of the piston heads of the inner cylinders;

providing a high pressure accumulator in communication with the high pressure side of the piston heads of the inner cylinders, the high pressure accumulator comprising the open volume surrounding the inner cylinders within the outer housing;

positioning the outer housing such that the piston rod of the inner cylinder of a first diameter extends upwardly and the piston rods of the plurality of inner cylinders extend downwardly;

connecting the inline compensator apparatus such that it is operable with the floating vessel's hoisting system;

allowing the piston rods of the inner cylinders to extend and retract to account for heave of the floating vessel.

55. The method of claim 54 wherein the piston rod of the inner cylinder of a first diameter is normally extended when the heave compensation system is in the static mode.

56. The method of claim 55 wherein the piston rods of the plurality of inner cylinders are normally retracted when the heave compensation system is in the static mode.

57. The method of claim 56 wherein the piston rods of the plurality of inner cylinders are extended to account for the floating vessel rising up the crest of a wave when the heave compensation system is operational.

58. The method of claim 57 wherein the piston rod of the inner cylinder of a first diameter is retracted to account for the floating vessel riding down to the trough between waves when the heave compensation system is operational.

59. The method of claim 58 wherein the piston rods of the plurality of inner cylinders are retracted to account for the floating vessel riding down to the trough between waves when the heave compensation system is operational.

60. A method of compensating for heave of a floating vessel comprising:

providing a heave compensation system having an outer housing sealed on both ends by end caps, the outer housing at least partially housing one or more upwardly facing inner cylinders and one or more downwardly facing inner cylinders providing each of the inner cylinders with a piston head and a piston rod therein, wherein the total cross-sectional area of the piston heads of the one or more downwardly facing inner cylinders is greater than the total cross-sectional area of the piston heads of the one or more upwardly facing inner cylinders, and wherein each of the piston rods of the inner cylinders extend through an end cap of the outer housing and have a connecting lug on the end of the piston rod outside the outer housing;

providing one or more low pressure accumulators in communication with the low pressure side of the piston heads of the inner cylinders;

providing a high pressure accumulator in communication with the high pressure side of the piston heads of the inner cylinders;

positioning the outer housing such that the piston rods of the one or more downwardly facing inner cylinders extend downwardly and the piston rods of the one or more upwardly facing inner cylinders extend upwardly;

connecting the inline compensator apparatus such that it is operable with the floating vessel's hoisting system;

allowing the piston rods of the inner cylinders to extend and retract to account for heave of the floating vessel.

61. The method of claim 60 wherein the piston rods of the one or more upwardly facing inner cylinders are normally extended when the heave compensation system is in the static mode.

62. The method of claim 61 wherein the piston rods of the one or more downwardly facing inner cylinders are normally retracted when the heave compensation system is in the static mode.

63. The method of claim 62 wherein the piston rods of the one or more downwardly facing inner cylinders are extended to account for the floating vessel rising up the crest of a wave when the heave compensation system is operational.

64. The method of claim 63 wherein the piston rods of the one or more downwardly facing inner cylinders are retracted to account for the floating vessel riding down to the trough between waves when the heave compensation system is operational.

65. The method of claim 64 wherein the piston rods of the one or more upwardly facing inner cylinders are retracted to account for the floating vessel riding down to the trough between waves when the heave compensation system is operational.

66. The method of claim 60 further comprising attaching the one or more low pressure accumulators to the outer surface of the outer housing.

67. The method of claim 61 wherein the one or more low pressure accumulators are attached to the outer surface of the outer housing by pipe supports.

68. The method of claim 60 further comprising housing the one or more low pressure accumulators at least partially within the outer housing.

69. The method of claim 60 further comprising attaching one or more of the low pressure accumulators to the outer surface of the outer housing and at least partially housing one or more of the low pressure accumulators within the outer housing.

70. The method of claim 60 further comprising forming the one or more high pressure accumulators out of the open space surrounding the inner cylinders within the outer housing.

71. The method of claim 60 further comprising providing the one or more high pressure accumulators as external accumulators attached to the outer surface of the outer housing.

72. The method of claim 60 further comprising providing one or more of the high pressure accumulators as an external accumulator attached to the outer surface of the outer housing and forming one or more of the high pressure accumulators out of the open space surrounding the inner cylinders within the outer housing.

* * * * *